US010065766B2

(12) United States Patent
Boukobza et al.

(10) Patent No.: US 10,065,766 B2
(45) Date of Patent: Sep. 4, 2018

(54) CONTAINER INCLUDING A RIBBED, ARCHED BOTTOM

(75) Inventors: Michel Boukobza, Octeville sur Mer (FR); Mikaël Derrien, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 773 days.

(21) Appl. No.: 13/703,193

(22) PCT Filed: Jun. 14, 2011

(86) PCT No.: PCT/FR2011/051337

§ 371 (c)(1),
(2), (4) Date: Feb. 14, 2013

(87) PCT Pub. No.: WO2011/154670

PCT Pub. Date: Dec. 15, 2011

(65) Prior Publication Data

US 2013/0175236 A1 Jul. 11, 2013

(30) Foreign Application Priority Data

Jun. 11, 2010 (FR) ..... 10 02485

(51) Int. Cl.

| | |
|---|---|
| ***B65D 90/12*** | (2006.01) |
| ***B65D 1/02*** | (2006.01) |
| ***B65D 23/00*** | (2006.01) |
| *B65D 90/02* | (2006.01) |

(52) U.S. Cl.
CPC ..... *B65D 23/001* (2013.01); *B65D 1/0261* (2013.01)

(58) Field of Classification Search
CPC ..... B29B 2911/1404; A47G 19/2255; B65D 1/0276; B65D 1/0284; B65D 1/0223; B65D 23/001; B65D 2501/0009; B65D 1/0261; B65D 1/24783
USPC ..... 215/371, 372, 373, 376
See application file for complete search history.

(56) References Cited

U.S. PATENT DOCUMENTS

| | | | | |
|---|---|---|---|---|
| 4,525,401 A | 6/1985 | Pocock et al. | | |
| 6,065,624 A * | 5/2000 | Steinke | B65D 1/0276 | 215/373 |
| 2007/0231530 A1* | 10/2007 | Pedmo | B65D 1/0276 | 428/66.3 |

(Continued)

FOREIGN PATENT DOCUMENTS

| | | |
|---|---|---|
| EP | 1 918 213 A1 | 5/2008 |
| WO | 2006/100374 A1 | 9/2006 |

(Continued)

OTHER PUBLICATIONS

International Search Report for PCT/FR2011/051337 dated Oct. 20, 2011.

*Primary Examiner* — J. Gregory Pickett
*Assistant Examiner* — Niki M Eloshway
(74) *Attorney, Agent, or Firm* — Sughrue Mion, PLLC

(57) ABSTRACT

A container made of plastic material, provided with a body and a bottom extending at a lower end of the body, the bottom including an annular seat extending substantially in the prolongation of the body and defining a seating plane; a concave arch that extends from a zone near the seat to a central zone, the arch including a series of stiffeners that extend radially from the central zone to the seat.

9 Claims, 9 Drawing Sheets

(56) References Cited

U.S. PATENT DOCUMENTS

| | | | | |
|---|---|---|---|---|
| 2008/0035601 | A1* | 2/2008 | Derrien | B65D 1/0261 215/376 |
| 2008/0047923 | A1* | 2/2008 | Zoppas | B65D 1/0223 215/371 |
| 2009/0194546 | A1 | 8/2009 | Lane | |
| 2009/0242575 | A1* | 10/2009 | Kamineni | B65D 1/0276 220/608 |
| 2010/0119643 | A1* | 5/2010 | Boukobza | B29C 49/48 425/522 |
| 2010/0297375 | A1* | 11/2010 | Protais | B65D 1/0284 428/36.92 |
| 2012/0111824 | A1* | 5/2012 | Ungrady | B65D 1/0223 215/381 |
| 2012/0118899 | A1* | 5/2012 | Wurster | B65D 1/0261 220/600 |

FOREIGN PATENT DOCUMENTS

| | | | |
|---|---|---|---|
| WO | 2007/055730 | A1 | 5/2007 |
| WO | 2010/061758 | A1 | 6/2010 |

* cited by examiner

CONTAINER INCLUDING A RIBBED, ARCHED BOTTOM

CROSS REFERENCE TO RELATED APPLICATIONS

This application is a National Stage of International Application No. PCT/FR2011/051337, filed on Jun. 14, 2011, which claims priority from French Patent Application No. 1002485, filed on Jun. 11, 2010, the contents of all of which are incorporated herein by reference in their entirety.

The invention relates to the manufacture of containers, such as bottles or jars, obtained by blowing or stretch-blowing preforms made of thermoplastic material.

The manufacture of a container by blowing generally consists of inserting a blank (a term designating either a preform or an intermediate container obtained by pre-blowing a preform) into a mold with the shape of the container, said blank having previously been heated to a temperature above the glass transition temperature of the material, and of injecting a gas (such as air) under pressure (equal to or more than 15 bars) into the blank. The blowing can be supplemented by a prior stretching of the blank by means of a slide rod.

The dual molecular orientation that the material undergoes during blowing (axial and radial, respectively parallel and perpendicular to the general axis of the container) gives the container a certain structural rigidity.

However, the reduction—dictated by the market—of the quantity of material used for manufacturing containers requires manufacturers to resort to contrivances of manufacturing or shape to rigidify their containers, bi-orientation having proved to be insufficient. The result is that two containers of equal weight do not necessarily have the same mechanical performance (strength, rigidity).

One well-known method of increasing the rigidity of a container is heat setting, which consists of heating the wall of the mold in order to increase the rate of crystallinity by means of heat. This method, illustrated by French patent FR 2 649 035 (Sidel) and its American equivalent U.S. Pat. No. 5,145,632, is employed particularly for heat resistant (HR) applications in which the container is hot filled.

However, because of its cost and the reduced production pace it requires, this type of method would not generally be used in ordinary applications such as flat water.

Another technical solution for increasing the structural rigidity of a container consists of over-stretching the bottom of the container by means of a mold specially equipped with a mold bottom movable in translation that pushes back the material (in particular, see European patent EP 1 069 983). The over-stretching causes an increase in the rate of deformation of the material and thus a mechanical increase in its crystallinity.

However, this technique—called "boxing"—requires extra material to be allocated to the bottom, without which the structural rigidity produced by the over-stretching of the material will be reduced by its thinning. In addition to the excess weight, the blowing pressure must be increased in order to properly form the bottom.

Moreover, the boxing of the bottom is generally coupled with heat setting, because it makes it possible to form deformable membranes that absorb the variations in volume of the container accompanying the retraction of the liquid initially filled when hot.

To date, lightweight containers intended for ordinary applications, for which heat setting or boxing technologies are not suitable for the reasons set forth above, do not offer a satisfactory mechanical performance. In particular, it has been noted that even when the rigidity of a lightweight container seems sufficient during filling, its palletization poses a problem because the weight of the stacked containers exerts stresses on the lower containers such that the bottoms tend to roll and the pallet tends to collapse.

An objective of the invention is to improve, at equal or lower weight, the mechanical performance of a container.

To that end, the invention proposes a container made of plastic material, provided with a body and a bottom extending at a lower end of the body, the bottom comprising:

- an annular seat extending substantially in the prolongation of the body and defining a seating plane;
- a concave arch that extends from a zone near the seat to a central zone, said arch comprising a series of stiffeners that extend radially from a central zone of the body to the seat.

Such a container has increased stability and rigidity, thanks particularly to the combination of the wide seat (in the prolongation of the body) and the stiffened arch.

According to one embodiment, the stiffeners extend to an inner annular cheek substantially perpendicular to the seating plane.

The axial dimension of the cheek and the radial dimension of the seating plane are preferably equivalent, to the benefit of the stability of the container.

Moreover, the bottom can comprise an annular reinforcing lip at the junction between the seat and the arch, which joins the outer radial ends of the stiffeners two at a time. For example, this annular lip has a V-shaped profile in cross-section, projecting inwards. At its junction with the stiffeners, the annular lip preferably has a local widening at its junction with the outer end of each stiffener.

According to one embodiment, each stiffener becomes thinner from the central zone of the body towards the seat, and together the stiffeners form a star motif.

For example, the arch comprises recessed panels between the stiffeners, and each stiffener comprises double radius connection fillets with the panels on its lateral edges.

Other objects and advantages of the invention will be seen from the following description, provided with reference to the appended drawings in which.

Figure 1:
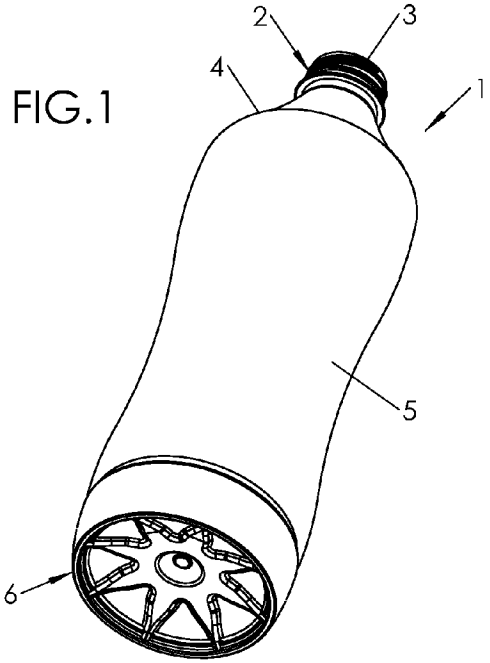
FIG. 1 is a view in perspective from below of a container made of plastic material.

Represented in FIG. 1 is a container 1, in this instance a bottle, produced by stretch-blowing of a preform made of thermoplastic material such as PET (polyethylene terephthalate).

Said container 1 comprises, at an upper end, a threaded neck 2, provided with a mouth 3. In the prolongation of the neck 2, the container 1 comprises in its upper part a shoulder 4 that widens out in the opposite direction of the neck 2, said shoulder 4 being extended by a lateral wall or body 5, generally cylindrical in revolution around a principal axis X of the container 1.

The container 1 further comprises a bottom 6 which extends at a lower end of the container 1.

Figure 4:
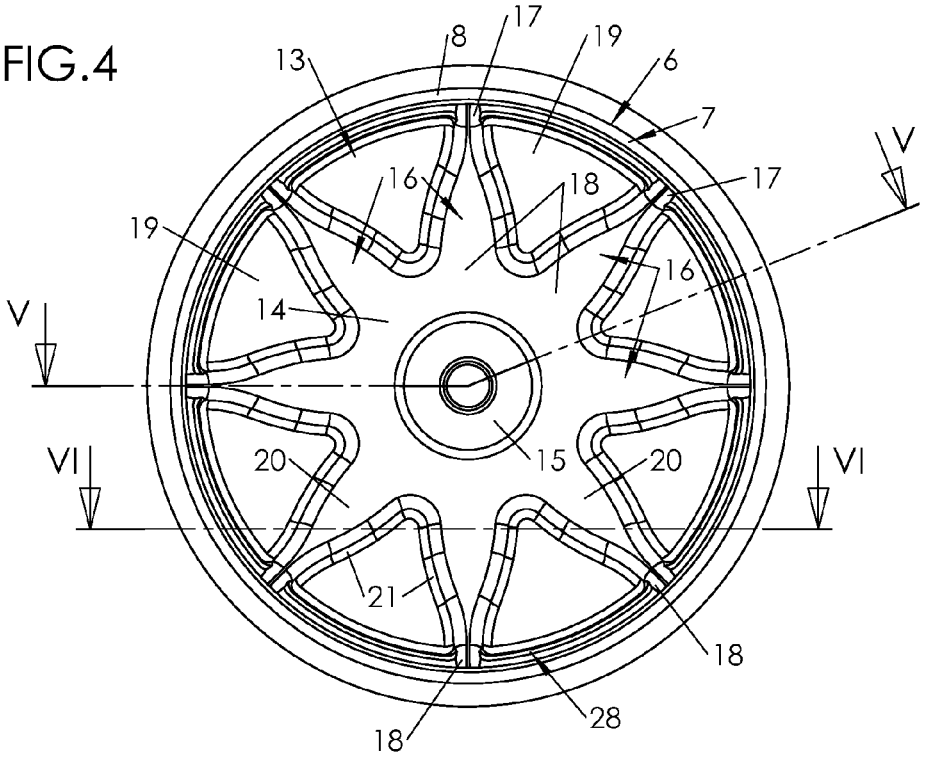
FIG. 4 is a plan view of the container from below.
Figure 5:
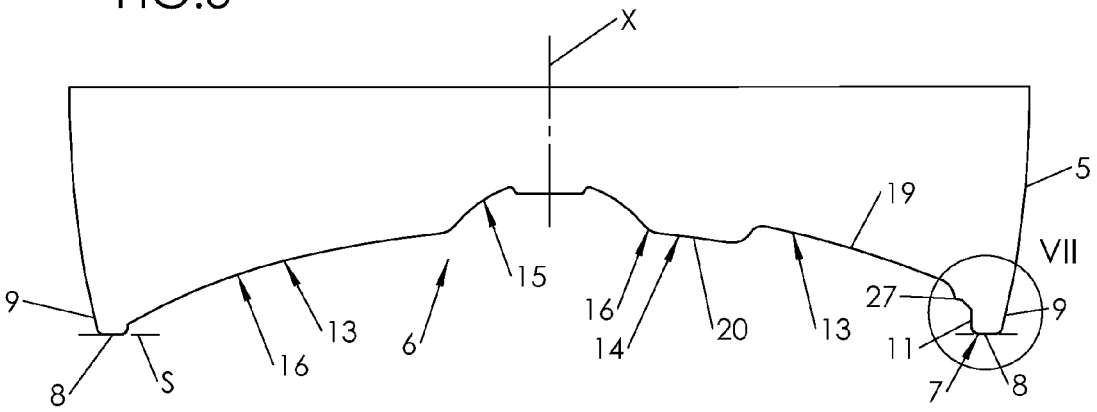
FIG. 5 is a cross-section of the bottom of the container, along the broken cut line V-V of FIG. 4.
Figure 6:
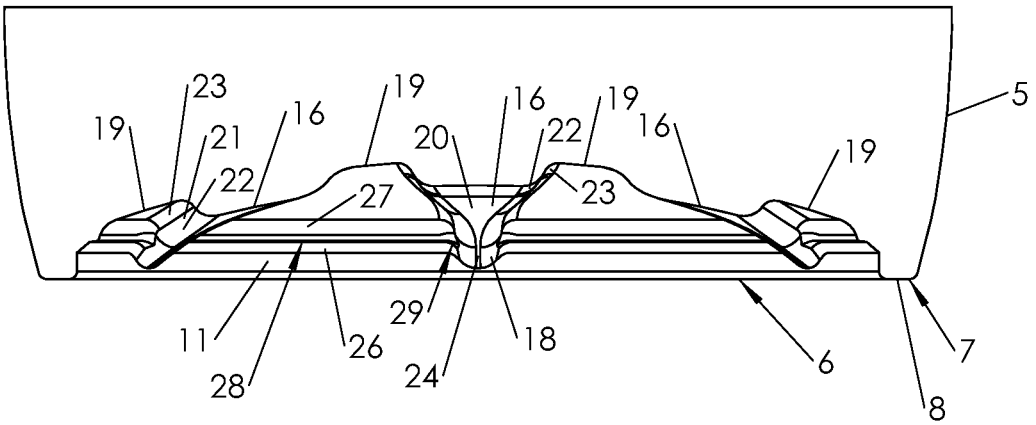
FIG. 6 is a cross-section of the bottom of the container, along the broken cut line VI-VI of FIG. 4.
Figure 7:
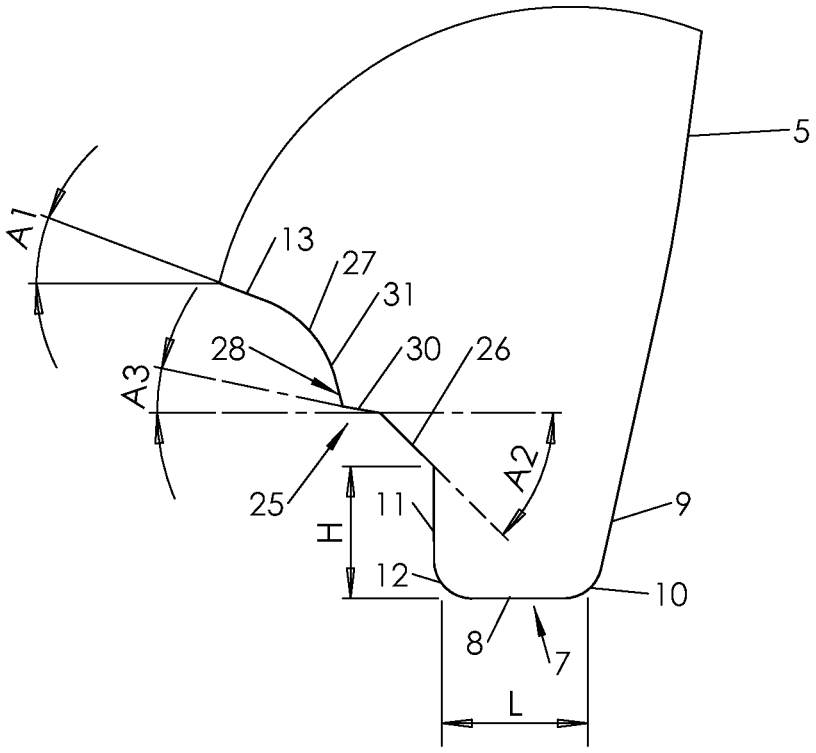
FIG. 7 is a detail of the cross-section of the bottom, according to inset VII of FIG. 5.

As can be seen in the drawings, and more particularly in FIGS. 5, 6 and 7, the bottom 6 comprises a seat 7 in the form of a thin annular bead that extends substantially axially in the prolongation of the body 5. The seat 7 terminates by a face (continuous and annular, as in the examples of FIGS. 2 to 19 and 22 to 24, or formed from several co-planar facets, as in the example of FIGS. 20 and 21) which forms the lower end of the container 1 and defines a seating plane 8 perpendicular to the axis of the container 1, by which said container can be placed stably on a flat surface S.

The seating plane 8 is connected outwards at an outer lateral face 9 of the seat 7 (which extends in the prolongation of the body) by a fillet 10 with small radius of curvature, i.e. on the order of 1 millimeter.

Towards the interior of the container 1, the seat 7 comprises an annular cheek 11 having a diameter D, which extends axially towards the interior of the container 1 in the prolongation of the seating plane 8, substantially at a right angle with respect thereto, at a height H equivalent to the width L of the seating plane 8, measured radially. More specifically, care will be taken that the ratio between the width L of the seating plane 8 and the height H of the cheek 11 falls between 0.6 and 1.5:

$$0.6 \leq \frac{L}{H} \leq 1.5$$

Figure 16:
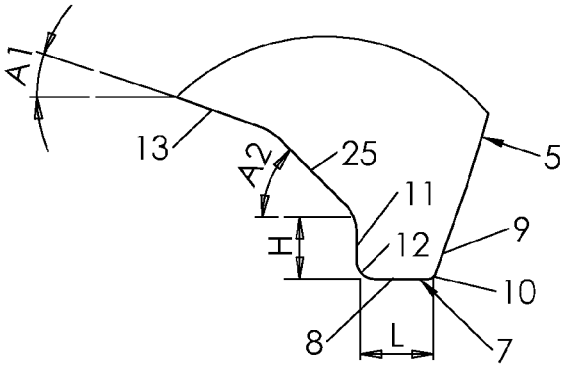
Figure 17:
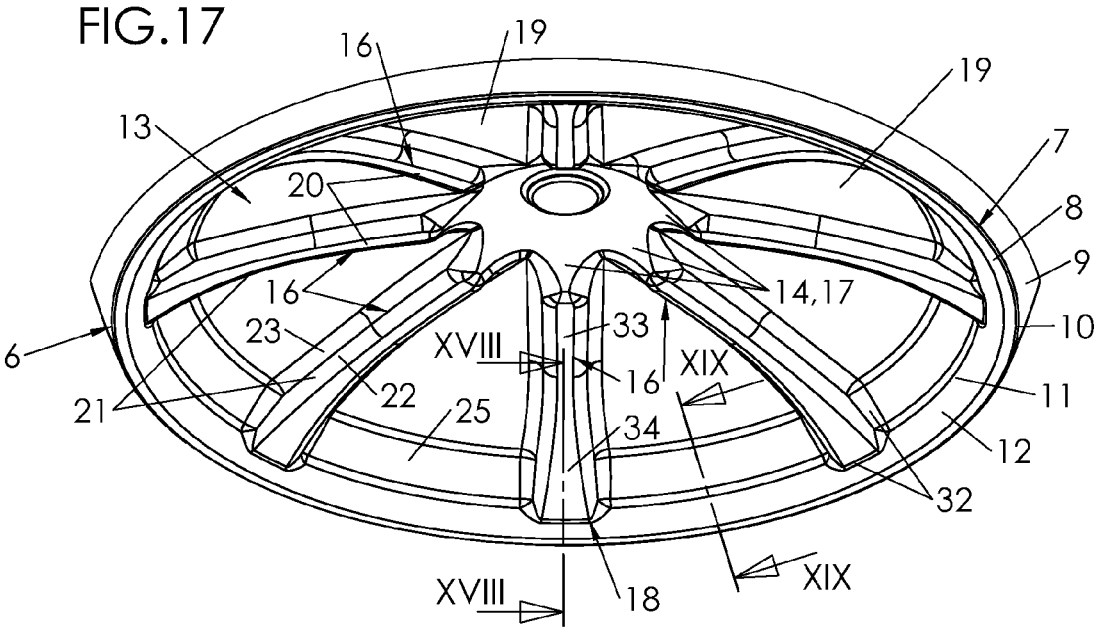
FIG. 17 is a view in perspective, similar to FIG. 2, illustrating a fifth embodiment of the bottom of the container.
Figure 18:
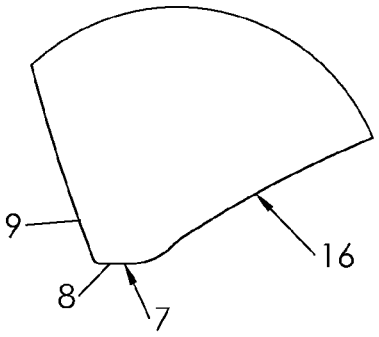
FIGS. 18 and 19 are detail views in cross-section, respectively along the cut planes XVIII-XVIII and XIX-XIX of FIG. 17.
Figure 19:
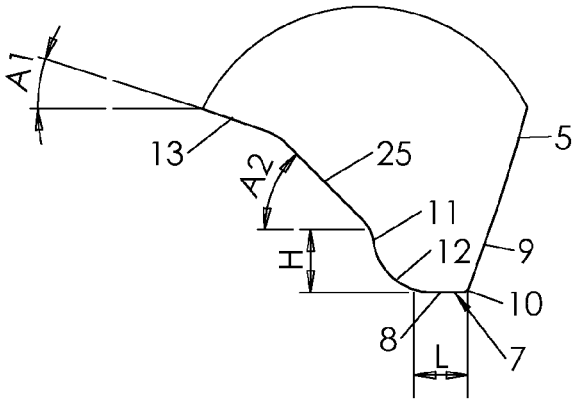

The seating plane 8 is connected toward the interior at the cheek 11 by a fillet 12 which can be of small radius of curvature—equal to or less than about 1 mm, as in the examples of FIGS. 2 to 16 and 20 to 24—or medium radius—between 1 mm and 5 mm, as in the example of FIGS. 17 to 19.

The bottom 6 further comprises a concave arch 13 (with concavity turned toward the exterior of the container 1 in the absence of stress, i.e. in the absence of contents in the container 1, which extends in the prolongation of the cheek 11 to a central zone 14 of the bottom 6, circumscribed within a circle with a diameter d.

The arch 13 is not deep, and its curvature is not pronounced. The maximum angle A1 of its tangent with a plane perpendicular to the axis of the container 1 (in this instance measured on an outer edge of the arch 13) is small, less than or equal to about 20°.

In the central zone 14, the bottom 6 comprises, in the prolongation of the arch 13, a central pin 15 that extends axially projecting towards the interior of the container 1.

The arch 13 is further provided with a series of stiffeners 16 in the form of projecting branches that extend radially from the central zone 14 of the bottom 6 to the cheek 11, and which together form a star-shaped motif.

The stiffeners 16 are connected by one inner radial end 17 to the central zone 14 of the body 6. The stiffeners 16 are connected by one outer radial end 18 to the cheek 11. In all of the illustrated embodiments, there are 8 stiffeners 16, but this number is provided by way of example and could be different. More specifically, this number can be between 4 and 12; for purposes of mechanical strength, it is preferably between 6 and 10. Similarly, the height, width and shape of the stiffeners 16 can vary depending on the applications. By way of example, as we will see hereinafter, the stiffeners can be arched in a Y-shape pointing towards the center or the periphery of the bottom, or straight, or X-shaped.

In order to give the bottom sufficient rigidity, the ratio d/D between the diameter d of the central zone 14 and the diameter D of the cheek 11 is minimized. The ratio d/D is preferably less than 1/2, otherwise the central zone 14 is not sufficiently rigid and there can be the risk of rolling over under the effect of the hydrostatic pressure of the contents of the container 1.

In the interstices between the stiffeners 16, the cheek 13 defines recessed panels 19 the profile of which is complementary to that of the stiffeners 16.

Each stiffener 16 has a concave lower face 20 that extends in the prolongation of the surface of the central zone 14, and two lateral edges 21 that form fillets 22, 23 that connect the lower face 20 with the recessed panels 19. As can be clearly seen in FIGS. 3, 8, 11, 14, 17, 20 and 22, the edges 21 have a double radius and comprise a first fillet 22 with convex profile, flush with the lower face 20, followed by a second fillet 23 with concave profile, flush with the panel 19.

As can also be seen in the drawings, the arch 13 is not directly connected to the cheek 11, but by an intermediate junction face 25 generally in the shape of a truncated cone of revolution around the axis X of the container 1.

The container 1 can be manufactured by stretch-blowing a preform made of plastic material such as PET. For the formation of the bottom 6, a boxing operation is advantageously used.

Various particular embodiments, having all of the characteristics described above but differing depending on the shape of the stiffeners 16, the shape of the central zone 14 and the geometry of the seat, particularly at the cheek 11, will now be described in greater detail.

A first embodiment is illustrated in FIGS. 2 to 7.

In this first embodiment, the stiffeners 16 are Y-shaped and become thinner from their inner end 17 to their outer end 18. As can be clearly seen in FIG. 3, the opposite lateral edges 21 of the same stiffener 16 are not joined at the outer end 18 thereof, but allow a strip 24 to remain of the lower face 20 of the stiffener 16 up to the cheek 11.

Figure 2:
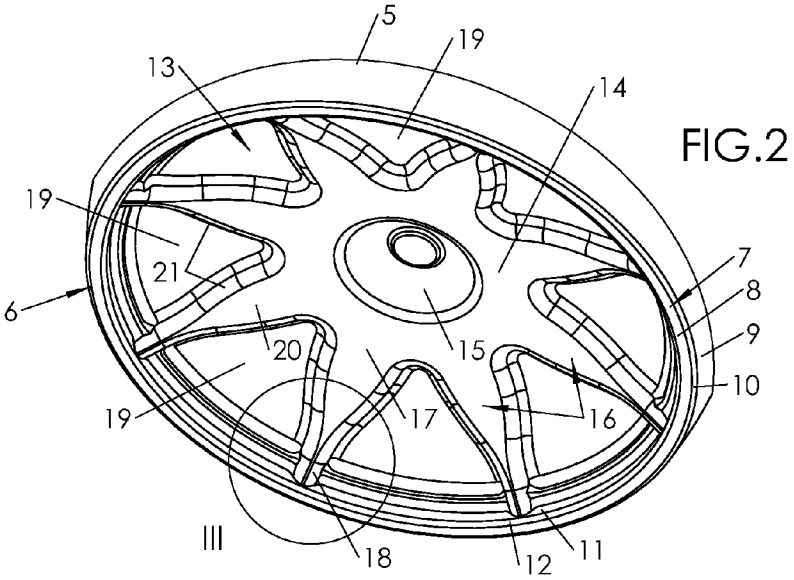
FIG. 2 is a view in perspective, in larger scale, showing the bottom of the container of FIG. 1 according to a first embodiment.

As can be clearly seen in FIG. 2, the inner ends 17 of the stiffeners 16 are separated from the central pin 15, so that the central zone 14 forms between the pin 15 and the inner ends 17, in the prolongation of the faces 20, a ring of material that encircles the pin 15.

In this first embodiment, as can be easily understood from FIGS. 4 and 5, the central zone 14 has a relatively large diameter D, the ratio d/D between the diameter d of the central zone 14 and the diameter D of the cheek 11 being close to 0.5. It is therefore necessary to provide the bottom 6 with increased rigidity.

In this instance, said increased rigidity is given to the periphery of the bottom 6 by the particular geometry of the face 25, which comprises:

- a truncated cone-shaped facet 26 extending in the prolongation of the cheek 11 and the angular opening A2 of which, measured with respect to a plane perpendicular to the axis X of the container 1 (or, in other words, with the seating plane 8), has a value (about 45°, as is illustrated in FIG. 7) equal to or greater than that of the angle A1 that the tangent to the arch 13 forms with this same plane at its outer peripheral edge;
- a connecting fillet 27 with the arch 13, with large radius of curvature (equal to or greater than about 5 mm);
- an annular reinforcing lip 28, surrounding the bottom 6, joins the outer ends 18 of the stiffeners 16 two by two. In cross-section, the lip 28 has a V-shaped profile (FIG. 7), which extends pointing substantially towards the axis X.

Figure 3:
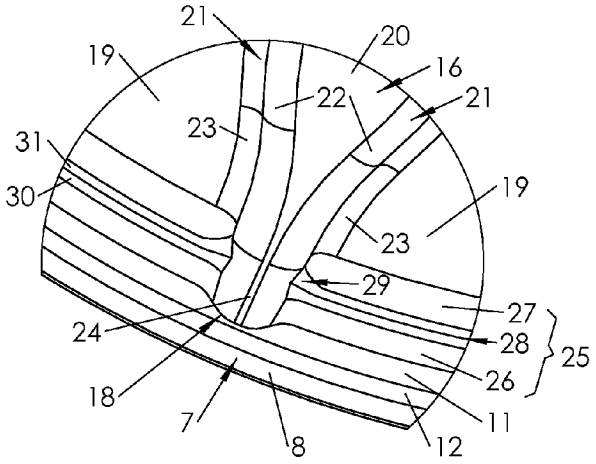
FIG. 3 is a detail view of the bottom of the container of FIG. 2, according to inset III.

As can be clearly seen in FIG. 3, the lip 28 has a local widening 29 at its junction with the outer end 18 of each stiffener 16.

The lip 28 has two flanks 30, 31, i.e. an outer flank 30 next to the facet 26, and an inner flank 31 next to the fillet 27 that connects with the arch 13. As can be seen in FIG. 7, the outer flank 30 has a straight profile in cross-section, and forms with a plane perpendicular to the axis (in other words with the seating plane 8) a small angle A3 equal to or less than about 20°. In the example illustrated, this angle A3 is about 10°.

The inner flank 31 also has a straight profile, and forms with the outer flank 30 an open angle (greater than 90°, such that the bisector of this angle forms a right angle or substantially right angle with the facet.

The annular reinforcing lip 28 also contributes to the rigidification of the seat 7. On the one hand, it decreases the risk of collapse of the seat 7 in the interval between two stiffeners 16, under the effect of stress tending to cause a rolling of the bottom 6. On the other hand, at its junction with the outer ends of the stiffeners 16, it contributes to the rigidity of the link between the stiffeners 16 and the seat 7, while in particular decreasing the risk of torsion of the stiffeners 16.

Finally, the fillet 12 has a small radius of curvature—equal to or less than about 1 mm.

Figure 8:
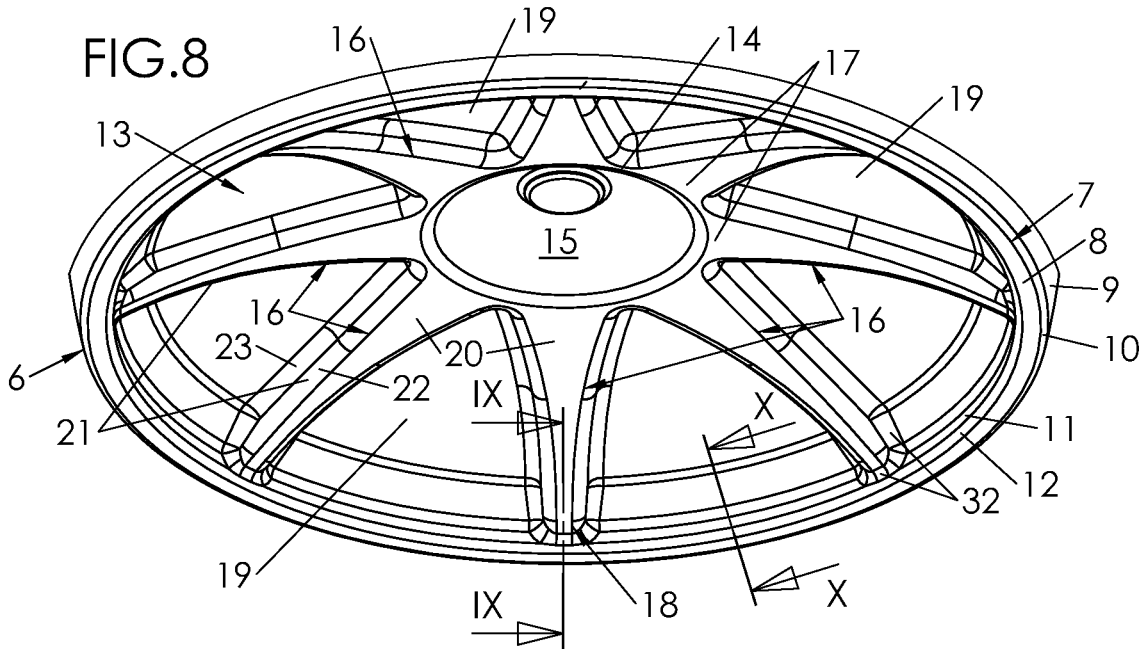
FIG. 8 is a view in perspective, similar to FIG. 2, illustrating a second embodiment of the bottom of the container.
Figure 9:
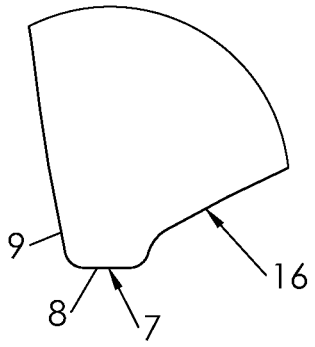
FIGS. 9 and 10 are detail views in cross-section, respectively along the cut planes IX-IX and X-X of FIG. 8.
Figure 10:
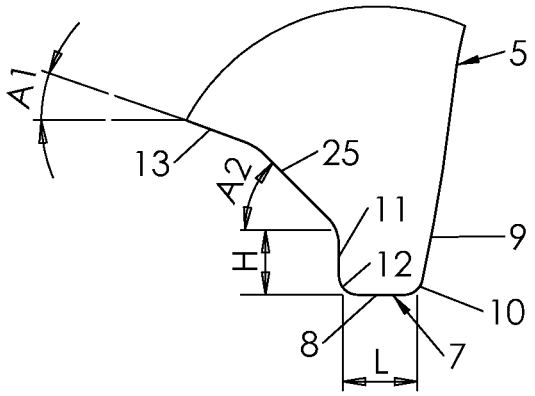

A second embodiment is illustrated in FIGS. 8, 9 and 10.

In this second embodiment, the stiffeners 16 are V-shaped and become thinner from their inner end 17 toward their outer end 18.

The central zone 14 is nearly reduced to the pin 15, only a thin ring of material separating the inner ends 17 of the stiffeners 16 from the pin 15. The ratio d/D between the diameter d of the central zone 14 and the diameter D of the cheek 11 is therefore relatively small, less than about 1/3, and the rigidity of the bottom 6 is therefore relatively large. For this reason, the face 25 has no annular reinforcing lip.

As can be seen in FIG. 10, the junction face 25 is smooth, and is limited to a truncated cone the angular opening A2 of which, measured with respect to a plane perpendicular to the axis X of the container 1 (or, in other words, with the seating plane 8), has a value of about 45°.

Moreover, as can be seen in FIG. 8, in order to improve the blowing ability of the bottom 6, connecting fillets 32 are provided at the outer ends 18 of the stiffeners, at their junction with the face 25 and their junction with the cheek 11.

The fillet 12 has a small radius of curvature—equal to or less than about 1 mm.

Figure 11:
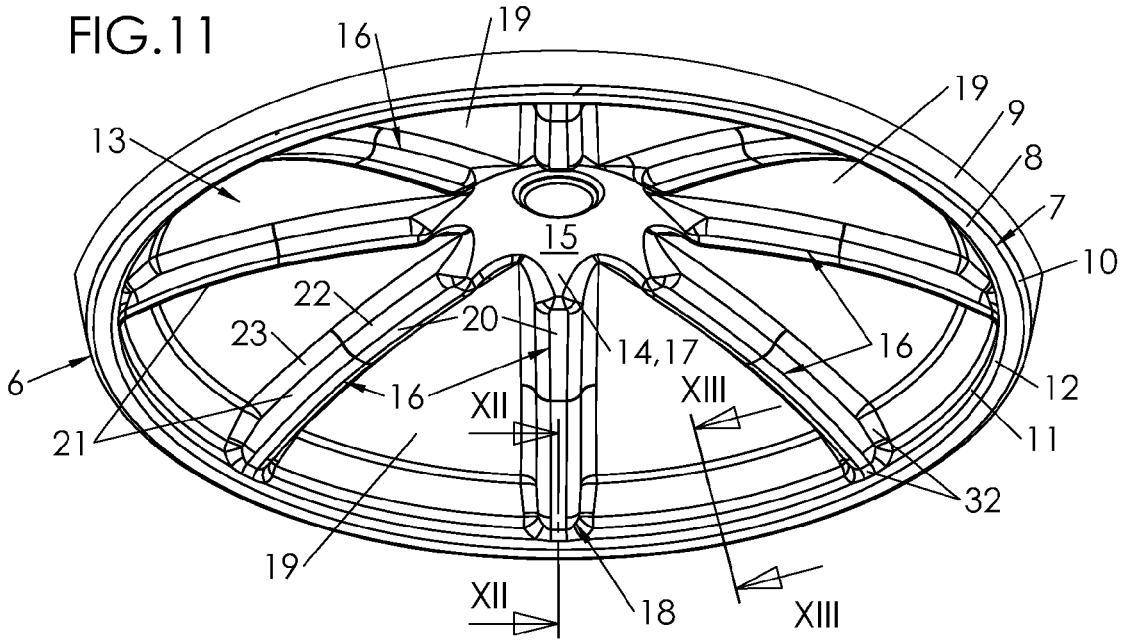
FIG. 11 is a view in perspective, similar to FIG. 2, illustrating a third embodiment of the bottom of the container.
Figure 12:
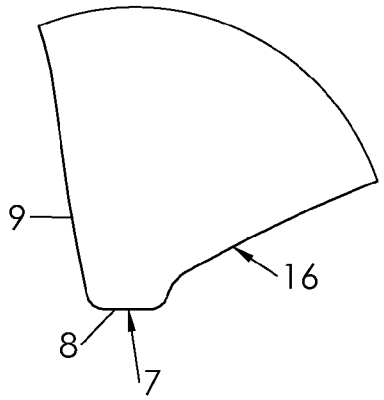
FIGS. 12 and 13 are detail views in cross-section, respectively along the cut planes XII-XII and XIII-XIII of FIG. 11.
Figure 13:
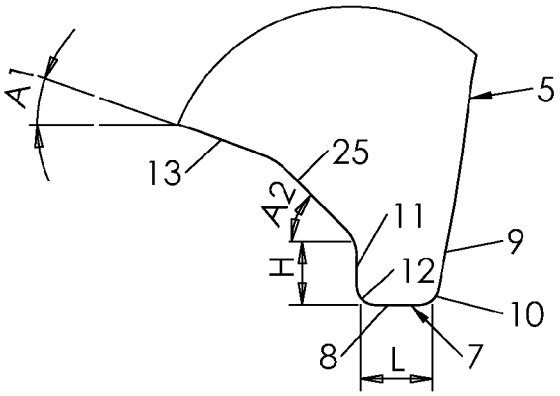

A third embodiment is illustrated in FIGS. 11, 12 and 13.

In this third embodiment, the stiffeners 16 have a straight I-shaped profile and a width that is substantially constant over approximately their entire length.

The central zone 14 is reduced to the pin 15, around the perimeter of which the inner ends 17 of the stiffeners 16 are delimited. As can be seen in FIG. 11, the pin 15 has a star-shaped profile, the inner ends 17 of the stiffeners 16 being thin and beveled.

Measured at the inner end 17 of the stiffeners 16, the diameter d of the central zone 14 (combined with the diameter of the pin 15) is such that the ratio d/D is about 1/4, and the rigidity of the bottom 6 is rather high. For this reason, the face 25 has no annular reinforcing lip.

As can be seen in FIG. 13, the junction face 25 is smooth and is limited to a truncated cone the angular opening A2 of which, measured with respect to a plane perpendicular to the axis X of the container 1 (or, in other words, with the seating plane 8), has a value of about 45°.

Moreover, as can be seen in FIG. 11, in order to improve the blowing ability of the bottom 6, connecting fillets 32 are provided at the outer ends 18 of the stiffeners, at their junction with the face 25 and their junction with the cheek 11.

The fillet 12 has a small radius of curvature—equal to or less than about 1 mm.

Figure 14:
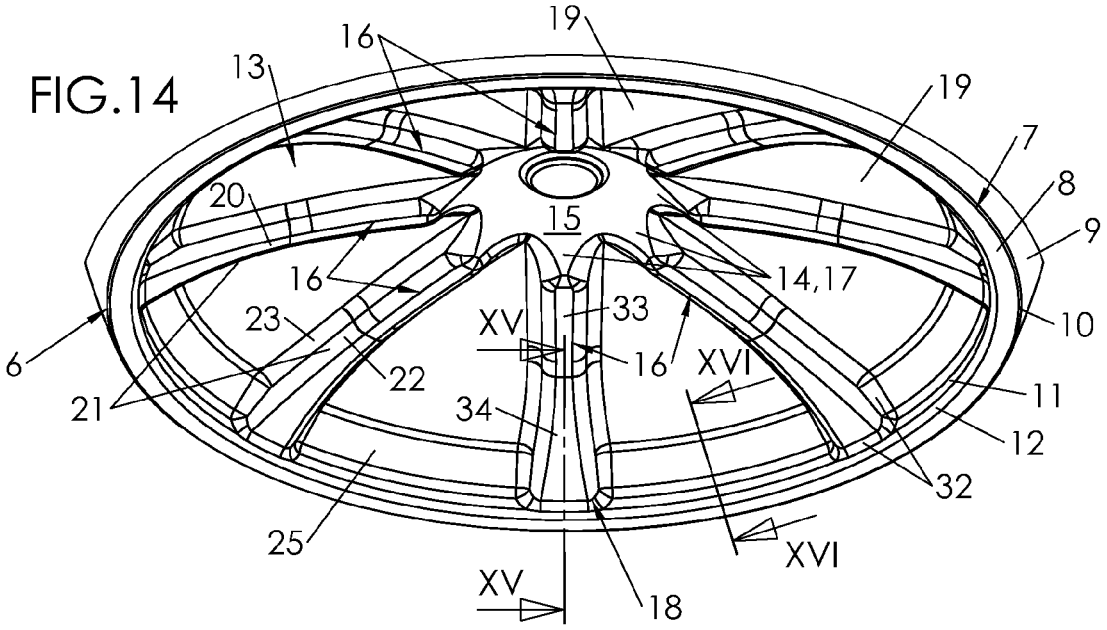
FIG. 14 is a view in perspective, similar to FIG. 2, illustrating a fourth embodiment of the bottom of the container.
Figure 15:
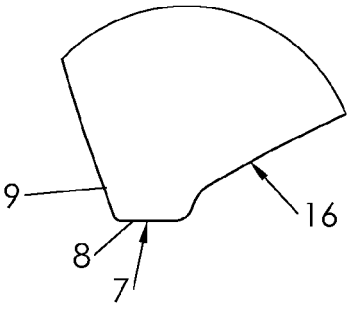
FIGS. 15 and 16 are detail views in cross-section, respectively along the cut planes XV-XV and XVI-XVI of FIG. 14.

A fourth embodiment is illustrated in FIGS. 14, 15 and 16.

In this fourth embodiment, the stiffeners 16 have a reverse Y-shaped profile, and over about half of their length have a straight I-shaped inner portion 33, of substantially constant width, which is extended by a reverse V-shaped upper portion 34, which widens from the inner portion 33 towards the outer end 18.

The central zone 14 is reduced to the pin 15, around the perimeter of which the inner ends 17 of the stiffeners 16 are delimited. As can be seen in FIG. 14, the pin 15 has a star-shaped profile, the inner ends 17 of the stiffeners 16 being thin and beveled.

Measured at the inner end 17 of the stiffeners 16, the diameter d of the central zone 14 (combined with the diameter of the pin 15) is such that the ratio d/D is about 1/4, and the rigidity of the bottom 6 is rather high. For this reason, the face 25 has no annular reinforcing lip.

As can be seen in FIG. 16, the junction face 25 is smooth and is limited to a truncated cone the angular opening A2 of which, measured with respect to a plane perpendicular to the axis X of the container 1 (or, in other words, with the seating plane 8), has a value of about 45°.

Moreover, as can be seen in FIG. 14, in order to improve the blowing ability of the bottom 6, connecting fillets 32 are provided at the outer ends 18 of the stiffeners, at their junction with the face 25 and their junction with the cheek 11.

The fillet 12 has a small radius of curvature—equal to or less than about 1 mm.

A fifth embodiment is illustrated in FIGS. 17, 18 and 19.

In this fifth embodiment, the stiffeners 16 have a reverse Y-shaped profile, and over about half of their length have a straight I-shaped inner portion 33, of substantially constant width, which is extended by a reverse V-shaped upper portion 34, which widens from the inner portion 33 towards the outer end 18.

The central zone 14 is reduced to the pin 15, around the perimeter of which the inner ends 17 of the stiffeners 16 are delimited. As can be seen in FIG. 17, the pin 15 has a star-shaped profile, the inner ends 17 of the stiffeners 16 being thin and beveled.

Measured at the inner end 17 of the stiffeners 16, the diameter d of the central zone 14 (combined with the diameter of the pin 15) is such that the ratio d/D is about 1/4, and the rigidity of the bottom 6 is rather high. For this reason, the face 25 has no annular reinforcing lip.

As can be seen in FIG. 19, the junction face 25 is smooth and is limited to a truncated cone the angular opening A2 of which, measured with respect to a plane perpendicular to the axis X of the container 1 (or, in other words, with the seating plane 8), has a value of about 45°.

Moreover, as can be seen in FIG. 17, in order to improve the blowing ability of the bottom 6, connecting fillets 32 are provided at the outer ends 18 of the stiffeners, at their junction with the face 25 and their junction with the cheek 11.

The fillet 12 has an average radius of curvature of between 1 mm and 5 mm. In the illustrated example, where the fillet 12 has a radius of curvature of about 2 mm and extends to the junction face 25 with the arch 13 (FIG. 19), it can be seen that it is an inner portion of the fillet 12 that forms the cheek 11 to which the stiffeners 16 are connected by their outer end 18 (FIG. 18). This feature of the embodiment is made possible by the high rigidity of the bottom 6 resulting from the small diameter of the central zone 14.

Figure 20:
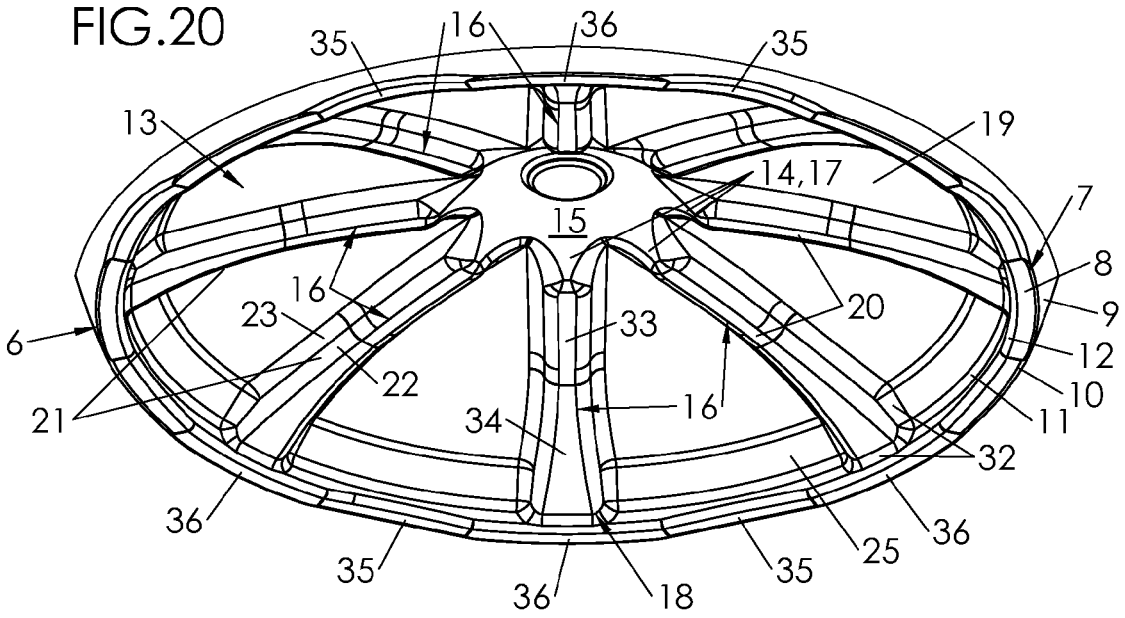
FIG. 20 is a view in perspective, similar to FIG. 2, illustrating a sixth embodiment of the bottom of the container.
Figure 21:
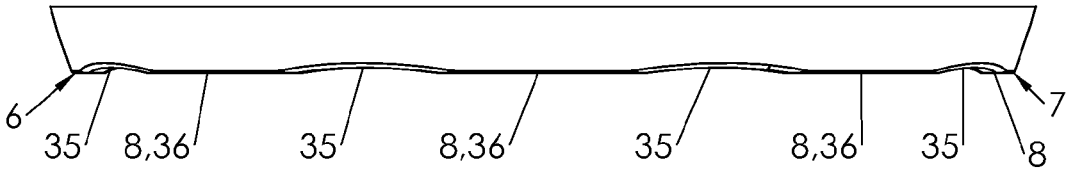
FIG. 21 is a side elevation view of the bottom of FIG. 20.

A sixth embodiment is illustrated in FIGS. 20 and 21.

In this sixth embodiment, the stiffeners 16 have a reverse Y-shaped profile, and over about half of their length have a straight I-shaped inner portion 33, of substantially constant width, which is extended by a reverse V-shaped upper portion 34, which widens from the inner portion 33 towards the outer end 18.

The central zone 14 is reduced to the pin 15, around the perimeter of which the inner ends 17 of the stiffeners 16 are delimited. As can be seen in FIG. 20, the pin 15 has a star-shaped profile, the inner ends 17 of the stiffeners 16 being thin and beveled.

Measured at the inner end 17 of the stiffeners 16, the diameter d of the central zone 14 (combined with the diameter of the pin 15) is such that the ratio d/D is about 1/4, and the rigidity of the bottom 6 is rather high. For this reason, the face 25 has no annular reinforcing lip and is limited to a truncated cone the angular opening A2 of which, measured with respect to a plane perpendicular to the axis X of the container 1 (or, in other words, with the seating plane 8), has a value of about 45°.

Moreover, as can be seen in FIG. 20, in order to improve the blowing ability of the bottom 6, connecting fillets 32 are provided at the outer ends 18 of the stiffeners, at their junction with the face 25 and their junction with the cheek 11.

The fillet 12 has a small radius of curvature—equal to or less than about 1 mm.

Furthermore, as can be clearly seen in FIG. 20 and better still in FIG. 21, arched notches 35, located angularly in each zone situated between the outer ends 18 of two adjacent stiffeners 16, are made in the seat 7. Thus, the seating plane 8 is discontinuous and is segmented in a peripheral series of coplanar facets 36 located in the prolongation of each stiffener 16, and separated two by two by a notch 35. When the container 1 is placed on a flat surface, only the facets 36 are in contact with said service, the notches 35 being separated therefrom. This configuration has the advantage of improving blowing ability and of better controlling the forming of the container 1, because during the molding of the bottom 6 the material in the seat 7 tends to spread naturally between the stiffeners 16, due to the local solidification of the material when it reaches the cavities of the stiffeners 16, which occurs before the formation of the seat 7.

Figure 22:
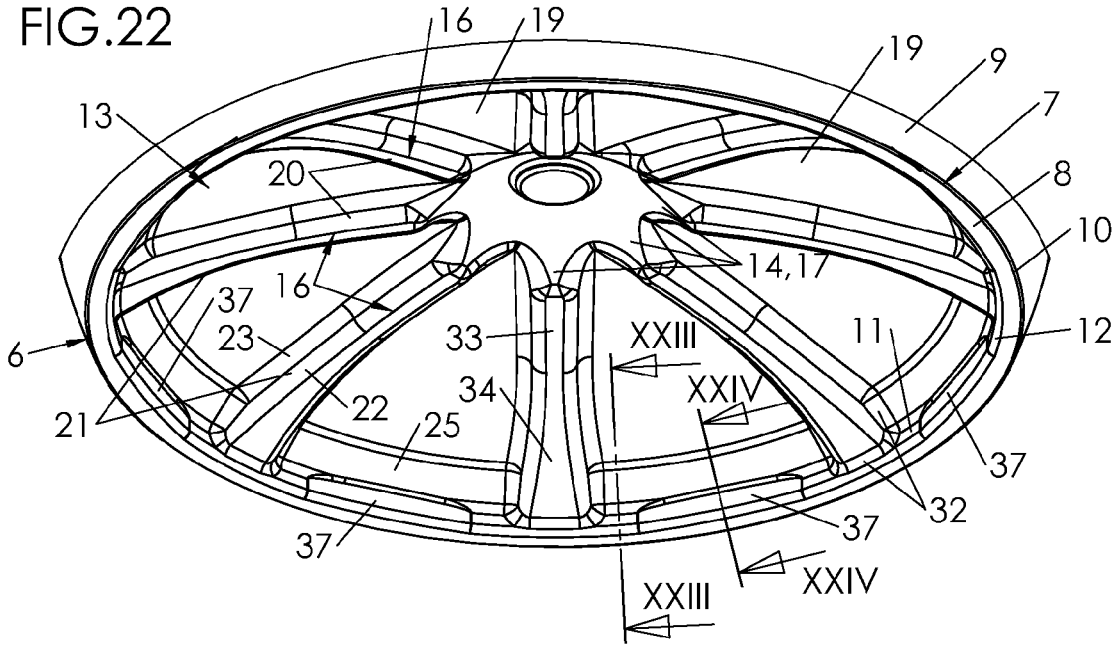
FIG. 22 is a view in perspective, similar to FIG. 2, illustrating a seventh embodiment of the bottom of the container.
Figure 23:
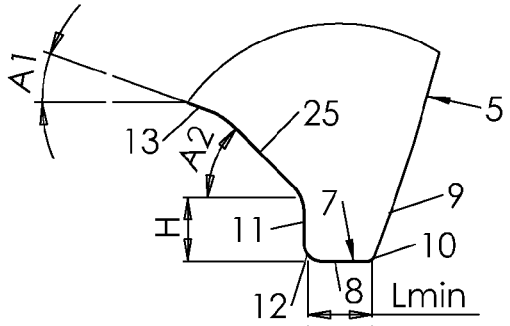
FIGS. 23 and 24 are detail views in cross-section, respectively along the cut planes XXIII-XXIII and XXIV-XXIV of FIG. 22.
Figure 24:
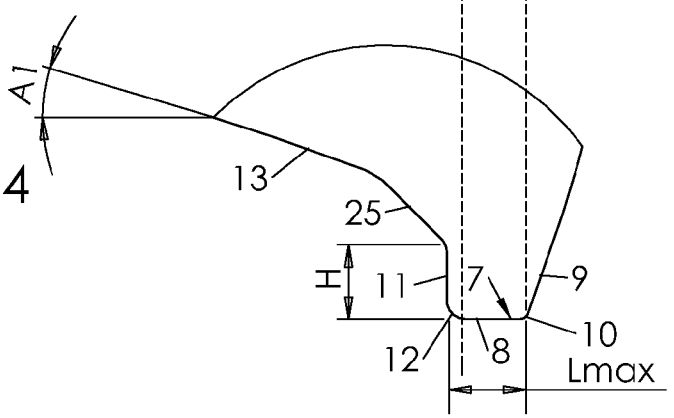

A seventh embodiment is illustrated in FIGS. 22, 23 and 24.

In this seventh embodiment, the stiffeners 16 have a reverse Y-shaped profile, and over about half of their length have a straight I-shaped inner portion 33, of substantially constant width, which is extended by a reverse V-shaped upper portion 34, which widens from the inner portion 33 towards the outer end 18.

The central zone 14 is reduced to the pin 15, around the perimeter of which the inner ends 17 of the stiffeners 16 are delimited. As can be seen in FIG. 22, the pin 15 has a star-shaped profile, the inner ends 17 of the stiffeners 16 being thin and beveled.

Measured at the inner end 17 of the stiffeners 16, the diameter d of the central zone 14 (combined with the diameter of the pin 15) is such that the ratio d/D is about 1/4, and the rigidity of the bottom 6 is rather high. For this reason, the face 25 has no annular reinforcing lip and is limited to a truncated cone the angular opening A2 of which, measured with respect to a plane perpendicular to the axis X of the container 1 (or, in other words, with the seating plane 8), has a value of about 45°.

Moreover, as can be seen in FIG. 22, in order to improve the blowing ability of the bottom 6, connecting fillets 32 are provided at the outer ends 18 of the stiffeners, at their junction with the face 25 and their junction with the cheek 11.

The fillet 12 has a small radius of curvature—equal to or less than about 1 mm.

Moreover, as can be seen in FIG. 22, and as also appears in FIGS. 23 and 24 beneath it, the seat 7 is reinforced by a peripheral series of curved surfaces 37 each formed to project radially inwards, on the cheek 11, between the outer ends 18 of two adjacent stiffeners 16. FIG. 22 shows that the curved surfaces 37, which are convex towards the axis X of the container 1, locally reverse the curvature of the cheek 11. As illustrated in FIGS. 23 and 24, the curved surfaces 37 locally widen the seat, the width L of which is therefore variable between a minimum value $L_{min}$ (at the stiffeners, FIG. 23) and a maximum value $L_{max}$ (in a median radial plane of the curved surfaces 37, coinciding with the cutting plane XXIV-XXIV).

This configuration has the advantage of improving the rigidity of the bottom 6, while improving blowing ability and better controlling the forming of the container 1, because in the seat 7 during the molding of the bottom 6, the material tends to extend naturally between the stiffeners 16, due to the local solidification of the material when it reaches the cavities of the stiffeners 16, which occurs before the formation of the seat 7.

Irrespective of the embodiment chosen, particularly among those that have just been described, for equal weight, the structure of the bottom 6 offers better mechanical performance than the structures of known bottoms. The wide seat 7, whose seating plane 8 diameter is substantially equal to that of the body 5 near the bottom 6, combined with the smaller radius of the outer fillet 10, provides the container 1 with better stability than a conventional seat whose seating plane diameter is substantially smaller than the diameter of the body, and whose fillet with a large radius favors rolling of the bottom.

This stability is increased even more by the stiffened arch 13. A non-stiffened arch, resulting only from boxing the bottom to produce the wide seat, would not sufficiently limit the risks of collapse of the container 1 under the effect of a load such as the kind to which palletized containers are subject.

The stiffeners 16 in the form of branches not only contribute to rigidifying the arch 13 in order to reduce the risk of deformation thereof, extreme deformation being the reversal of the arch. The stiffeners 16 act as knee braces, providing a radial absorption of the axial stresses exerted on the arch 13 by the hydrostatic pressure from the contents of the container 1. The stiffeners 16 are supported against the cheek 11 at their ends, the radial absorption of the stresses resulting in a permanent centrifugal radial stress exerted by the stiffeners 16 on the seat 7 via the cheek 11, which contributes to rigidifying the seat 7, while preventing its ovalization.

With regard to dimensional recommendations, tests have shown that the rigidity of the bottom 6 is optimal when the cheek 11 and the seating plane 8 have dimensions, respectively axial and radial, that are similar, as was explained above.

Indeed, the rigidity is the best when these dimensions are equal, but the performance offered by a L/H ratio of between 0.6 and 1.5 is good.

The invention claimed is:

1. A container made of plastic material, provided with a body and a bottom extending at a lower end of the body, the bottom comprising:

an annular seat extending substantially in the prolongation of the body and defining a seating plane;

a concave arch that extends from a zone near the seat to a central zone;

wherein the arch comprises a series of stiffeners that extend radially from the central zone to an inner annular cheek substantially perpendicular to the seating plane; the seating plane is connected toward the interior at the cheek by a fillet, the stiffeners become thinner from their inner end to their outer end; and wherein the stiffeners extend into the annular cheek to the seat; and wherein the bottom comprises an annular reinforcing lip at a junction between the seat and the arch, joining the outer radial ends of the stiffeners two by two.

2. The container according to claim 1, wherein the bottom has a junction face in the shape of a truncated cone, between the arch and the cheek.

3. The container according to claim 1, wherein the axial dimension of the cheek and the radial dimension of the seating plane are equivalent.

4. The container according to claim 1, wherein the stiffeners together form a star-shaped motif.

5. The container according to claim 1, wherein the arch comprises recessed panels between the stiffeners, and wherein each stiffener comprises on lateral edges of the stiffener double radius connection fillets with the panels.

6. The container according to claim 1, wherein the seating plane is continuous.

7. A container made of plastic material, provided with a body and a bottom extending at a lower end of the body, the bottom comprising:

an annular seat defining a seating plane of the container;

a fillet directly connected to an inner radial edge of the annular seat on an outward radial edge of the fillet;

an upwardly extending cheek directly connected to the fillet on an inward radial edge of the fillet, and the cheek substantially perpendicular to the seating plane;

a concave arch that extends from a central zone of the bottom toward the seat;

wherein the arch comprises a series of stiffeners that extend radially from the central zone towards and into the cheek; and wherein the bottom comprises an annular reinforcing lip at a junction between the seat and the arch, joining respective outer radial ends of the stiffeners two by two.

8. The container according to claim 1, wherein the stiffeners become thinner from respective inner ends of the stiffeners to the respective outer ends of the stiffeners.

9. The container according to claim 1, wherein the stiffeners extend to the seat.

* * * * *